United States Patent [19]

Chierici

[11] 4,030,613

[45] June 21, 1977

[54] UNCOUPLING LEVER ARRANGEMENT FOR RAILROAD CARS WITH STANDARD DRAFT GEAR CUSHIONING

[75] Inventor: Osvaldo F. Chierici, Elmhurst, Ill.

[73] Assignee: Holland Company, Lombard, Ill.

[22] Filed: Aug. 27, 1976

[21] Appl. No.: 718,357

Related U.S. Application Data

[63] Continuation of Ser. No. 578,321, May 16, 1975, abandoned.

[52] U.S. Cl. ..... 213/166; 213/219

[51] Int. Cl.[2] ..... B61G 3/08

[58] Field of Search ..... 213/166–171, 213/219, 211

[56] References Cited

UNITED STATES PATENTS

| | | | |
|---|---|---|---|
| 1,230,203 | 1/1917 | Murray | 213/171 X |
| 2,000,987 | 5/1935 | Richards | 213/171 |
| 3,227,289 | 1/1966 | Cseri | 213/171 X |
| 3,409,146 | 11/1968 | Taylor | 213/166 |

*Primary Examiner*—Stanley H. Tollberg
*Assistant Examiner*—John P. Shannon
*Attorney, Agent, or Firm*—McWilliams & Mann

[57] ABSTRACT

An uncoupling lever arrangement for railway cars equipped with standard draft gear cushioning including an uncoupling lever assembly comprising a handle section and a lock lifter section, each including an elongate bar formed from tube stock of quadrilateral transverse cross-sectional configuration. The handle section has a U-shaped handle affixed to one end of its bar at the outboard end of the lever assembly, which handle is mounted in the car body bracket, and the lock lifter section bar has a lock lifter rod member affixed to the inboard end of same that is formed with the usual hook eye formed for conventional application to the coupler lock lifter. The lever assembly bars are of complementary configuration whereby one end of one of the bars is received in the other end of the other bar to support the bars, and thus the lever assembly, in their operative position from the car body bracket and the coupler lock lifter. The parts are arranged such that the contacting portions of the lever assembly handle and the car body bracket have less static friction than the contacting surfaces of the lever assembly bars, whereby the assembly is adjustable in length on application, but remains of set length after installation without the assembly bars being fixed together, with sidewise shifting of the lever assembly that is occasioned by coupler side swing being accommodated at the car body bracket.

5 Claims, 11 Drawing Figures

UNCOUPLING LEVER ARRANGEMENT FOR RAILROAD CARS WITH STANDARD DRAFT GEAR CUSHIONING

This application is a continuation of my application Ser. No. 578,321, filed May 16, 1975 abandoned.

This invention relates to an uncoupling lever arrangement for railroad cars, and more particularly, to an uncoupling lever arrangement that is especially adapted for use with railroad cars equipped with standard draft gear cushioning and standard striker openings.

Uncoupling levers for cars equipped with standard draft gear cushioning, in accordance with standard practices, have usually been in the form of an operating rod that is rigid against extension and contraction lengthwise thereof, with the connection of the operating rod to the car accommodating the relatively small movement of the operating rod laterally of the car that is required to accommodate coupler side swing and coupler impacts in standard draft gear cushioning cars.

Furthermore, prior art uncoupling rods of this type have come to be made in many shapes and sizes for particular car applications, and are thus not interchangeable between cars. Conventional uncoupling levers of fixed length frequently require some adjustment of length in application, and not infrequently when application of the uncoupling rod to a car is made it necessary to uncouple the car or dismantle the coupler.

The principal objective of the present invention is to provide an uncoupling lever arrangement that is specifically designed for use in connection with cars equipped with standard draft gear cushioning and standard striker openings, which arrangement is of universal application insofar as cars of this type are concerned, even though some cars may require modification of the uncoupling lever assembly length to apply same, either as new equipment or to replace existing levers.

Another principal object of the invention is to provide an uncoupling lever arrangement for cars equipped with standard draft gear cushioning and standard striker openings in which the uncoupling lever assembly involved is made up of separate discrete sections that accommodate adjustment of uncoupling lever length between the car body bracket and the coupler lock lifter, for facilitating installation, but when installed, the resulting lever assembly remains at the installed length during service, with the relatively small amount of sidewise movement of the lever assembly due to coupler side swing and coupler impacts being accommodated at the car body bracket.

Another important object of the invention is to provide an uncoupling lever arrangement for cars equipped with standard draft gear cushioning and standard striker openings in which the lever assembly may be applied to and removed from the car without uncoupling the car or dismantling the coupler, and which avoids damaging the lever assembly of the invention when being removed for any reason whatever.

Other important objects of the invention are to provide an uncoupling lever arrangement for railroad cars equipped with standard draft gear cushioning and standard striker openings that provides for an uncoupling lever assembly arrangement that permits inventorying only of one uncoupling lever assembly for replacement purposes, that permits separate replacement of discrete basic components of the assembly, and that provides an uncoupling lever arrangement that is economical of manufacture, convenient to apply, and long lived in operation.

In accordance with the invention, the uncoupling lever arrangement comprises discrete handle and lock lifter sections each including an elongate bar formed from tube stock of quadrilateral transverse cross-sectional configuration. The handle section has a U-shaped handle affixed to one end of its bar at the outboard end of the handle section that is mounted on the car body bracket to support the uncoupling lever assembly at its outboard end. The lock lifter section bar has a lock lifter rod member affixed to one end of same at the inboard end of the assembly, which rod member is formed with the usual hook eye adapted for conventional application to the coupler lock lifter for supporting the lever assembly at its inboard end.

The lever assembly bars are of complementing configuration whereby the free end of one of the bars is received in the free end of the other bar to support the section bars, and thus the lever assembly, in their operative positions between the car body bracket and the coupler lock lifter.

The lever assembly and body bracket are arranged such that the contacting portions of the lever assembly handle and body bracket have less static friction, in resisting movement of the lever assembly sidewise of the car (due to coupler side swing and the like) than the contacting surfaces of the assembly bars, whereby the lever assembly is adjustable in length in application, but remains of set length after installation, with sidewise shifting movement of the lever assembly being accommodated at the car body bracket.

The parts are proportioned such that when the lever assembly is in its operative position, the assembly bars are substantially horizontally disposed for effective operation of the lock lifter when the car is to be uncoupled.

The handle and lock lifter sections of the lever assembly are freely separable on disconnection of the handle section from the car to permit ready replacement of either section if desired, and ready application to the car of the assembly without having to uncouple the car or dismantle the coupler knuckle assembly.

Other objects, uses, and advantages will be obvious or become apparent from a consideration of the following detailed description and the application drawings in which like reference numerals indicated like parts throughout the several views.

IN THE DRAWINGS

FIG. 6 is a plan view of the handle section of the uncoupling lever assembly while

FIG. 8 is a plan view of the lock lifter section of the uncoupling lever assembly while

Figure 1:
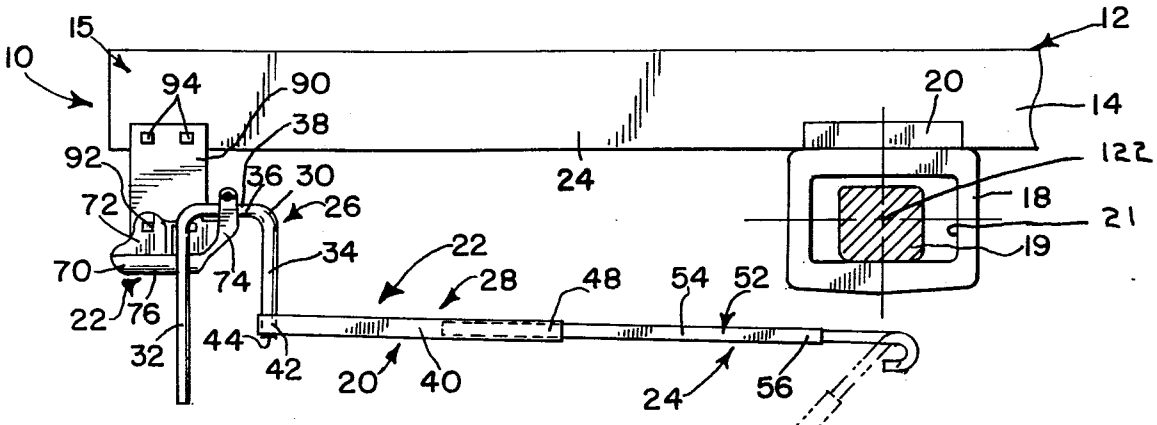
FIG. 1 is a diagrammatic end view of one end of a railroad car showing one embodiment of the invention applied thereto, with the coupler omitted and the coupler shank shown in section.

However, it is to be distinctly understood that the specific drawing illustrations provided are supplied primarily to comply with the requirements of the Patent Laws, and that the invention may have other embodiments that will be obvious to those skilled in the art, and which are intended to be covered by the appended claims.

GENERAL DESCRIPTION

Reference numeral 10 of the drawings generally indicates a preferred embodiment of the invention applied between the end 12 of a car body underframe 14 and a coupler 16 that is suitably mounted on the car 15 of which the underframe 14 forms a part.

The underframe 14 is intended to represent a typical flat car having the usual fixed center sill 18 equipped with the usual striker 20. Coupler 16 is operatively mounted in the fixed sill 18 in any conventional manner, and it is assumed that it is operably connected to the center sill and/or the car body 14 through a conventional type of draft gear mechanism, an example of which is shown in U.S. Pat. No. 2,811,263, whereby the car 15 is equipped for standard draft gear cushioning of coupler impacts applied to the coupler 16 (standard draft gear travel being approximately 3¾ inches for buff impacts and approximately 1¼ inches for draft impacts). Sill 19 defines striker opening 21, which is assumed to be of standard size (and thus have a width in the range of 11 2/8 – 11½ inches).

As is well known in the art, the car body 14 is supported on the railroad track (not shown) by suitable trucks (not shown), and the shank 19 of the coupler 16 is secured to the car for swinging movement to either side of the car center line.

The uncoupling arrangement 10 generally comprises an uncoupling lever assembly 20 applied between the car body bracket 22 that is suitably anchored to the car body end sill 25 and the lock lifter or unlocking knuckle 26 of the coupler.

The uncoupling lever assembly 20 generally comprises a handle section 28 and a lock lifter section 24 that are separate and discrete in arrangement, with the handle and lock lifter sections 23 and 24 being arranged for interfitting relationships whereby the liver assembly 20 may be supported from the car at its outboard end by the car body bracket 22, and by the coupler lock lifter 26 at the assembly inboard end.

Handle section 23 of assembly 20 comprises handle segment 27 that is secured to elongate bar 28 at the outboard end of the assembly 20. The handle segment 27 comprises U-shaped rod member 30 shaped to define elongate rectilinear legs 32 and 34 that are in substantial parallelism, and are joined together by a connection portion 36, which between the legs 32 and 34 defines a rectilinear section 38 that is mounted on the body bracket 22.

Figure 6:
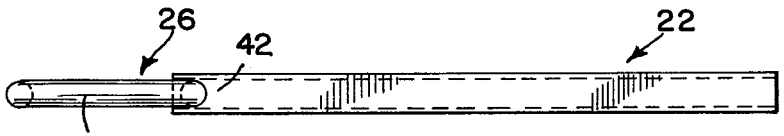
Figure 7:
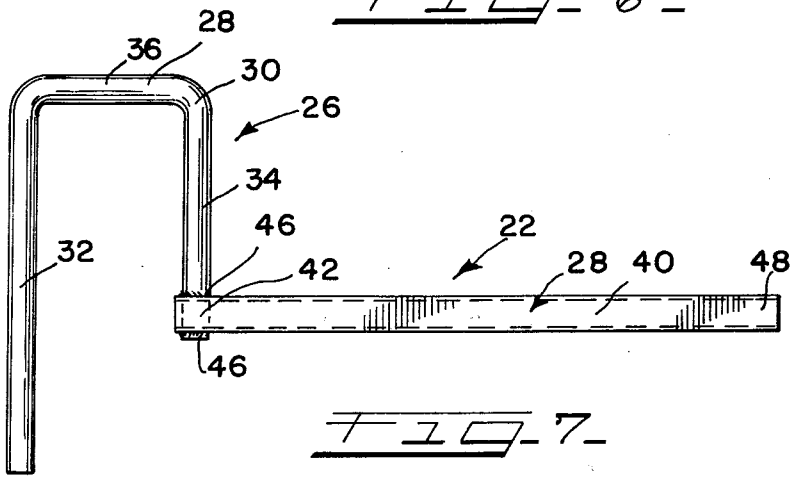
FIG. 7 is a side elevational view of same.

The bar 28 comprises a tubular member 40 of uniform quadrilateral transverse cross-sectional configuration throughout its length (square in the illustrated embodiment) to the outboard end 42 of which is affixed the leg 34 of handle segment 27. In the embodiment FIGS. 1–9, the bar 28 and handle segment 27 are in coplanar relation (see FIGS. 2 and 6), with the terminal end portion 44 of handle segment length 34 extending through tubular member 40 and being welded thereto as indicated at 46.

The longer leg 32 of handle segment 27 forms the hand grasping component of the assembly 20 and preferably is proportioned in length to extend well below the bar 28 in the operative position of same.

The tubular member 40 at its end 48 is open (see FIG. 4) for application thereto of the lock lifter section 24.

The lock lifter section 24 comprises elongate rectilinear bar 52 in the form of tubular member 54 of quadrilateral transverse cross-sectional configuration throughout ist length (square in the illustrated embodiment), which has affixed to its end 56 rod member 58 that has its end 60 shaped to define the usual hook eye 62 having its end 64 received inside the end 56 of tubular member 54 and suitably affixed thereto, as by welding.

Figure 2:
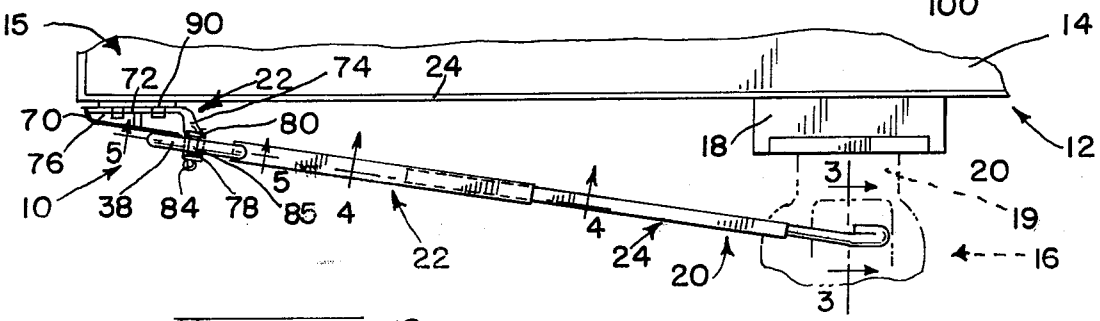
FIG. 2 is a plan view of the structure shown in FIG. 1, with the coupler being shown in phantom.
Figure 4:
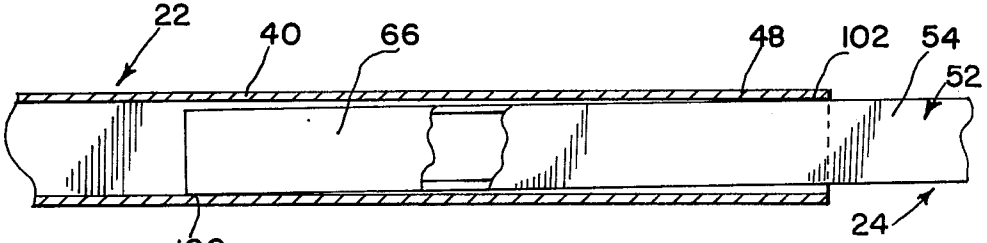
FIG. 4 is a fragmental cross-sectional view of the interengaged parts of the lever assembly, taken substantially along line 4—4 of FIG. 2.
Figure 5:
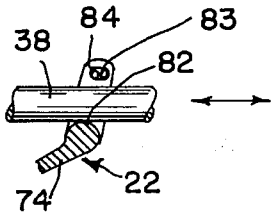
FIG. 5 is a fragmental sectional view taken substantially along line 5—5 of FIG. 2.

As indicated in FIGS. 1, 2 and 4, the other end 66 of tubular member 54 is received within the end 48 of the handle section member 40. Tubular members 40 and 54 are proportioned in transverse cross-sectional configuration to permit the end 66 of the member 54 to fit within the end 48 of the member 40 in close fitting relation thereto. In practice it is preferred that those parts be proportioned so that when the member 54 is centered within the member 40, there is approximately a 0.015 inch clearance between the two members on each side of same. Thus, member 40 and 54 are of substantially, but not exact, complemental configuration so that while the end 66 of member 54 will freely fit within the end 48 of member 40, there will be neither excessive play or lost motion between the parts nor a jamb type fit.

The body bracket 22 comprises a bracket body 70 including an attachment flange 72 that is integral with a support wall 74 and a reinforcing flange 76. The support wall 74 defines a pair of upstanding arms 78 and 80 on either side of the convexly rounded mounting surface 82 (see FIG. 5) on which the rectilinear section 38 of the lever assembly handle assembly 26 is adapted to rest in the operative position of the assembly 20. The arms 78 and 80 are apertured as at 83 to receive a suitable fastening or retaining device, such as the cotter pin 84, and are spaced apart sufficiently to freely receive section 38 of handle segment 27 and permit pivotal movement of the assembly 20 about a vertical axis 85 passing through surface 82 (see FIG. 2).

The body bracket 22 is suitably secured to the end 12 of the car 15 at one side of the car. In the form shown, the body bracket 22 has its flange 72 affixed to a mounting plate 90 by suitable bolts 92, with the mounting plate 90 being suitably secured to the car end 12 by employing suitable bolts 94. However, the manner of securing the body bracket 22 to the car is entirely optional and will depend on the type of car to which the invention is being applied. In some instances the body bracket 22 will be applied directly to the car.

The lever assembly handle section 2 and lock lifter section 24 are separate and discrete components, which are separated for application to the car. The lock lifter section 24, as separated from its handle section 22, may be applied to the coupler by angling same downwardly in the manner indicated in broken lines in FIG. 1 to apply the hook eye 62 to the coupler lock lifter 26, in the manner indicated in FIG. 3, after which the lock lifter section 24 may be swung vertically to dispose the lock lifter section tubular member 54 so as to position its end 66 within the end 48 of the handle section tubular member end 48, after which the rectilinear section 38 of handle segment 27 may be rested on the body bracket support or mounting surface 82, in between the body bracket legs 78 and 80. Application of cotter pin 84 or some other suitable type of fastening device to the body bracket finger apertures 83 completes installation.

The lever assembly 20 has several surfacing proportioning relationships that are critical to the functioning of this device.

In accordance with the invention, it is important that the static friction between the engaging surfaces of the assembly members 40 and 54 exceed that of the engaging portions of the handle segment rectilinear section 38 and the body bracket mounting surface 82 so that while assembly 20 may have its length varied for application of the device to the car, the length of the assembly 20 remains the same during use on the car (assuming application to a car equipped with standard draft gear cushioning and a standard striker opening), with sidewise movement of the assembly 20, resulting due to coupler side swing and, to a lesser extent, buff and draft impacts, being accommodated at the body bracket mounting surface 828

For purposes of this invention, the term "static friction" refers to the force resisting, in the case of the handle segment 27 and the body bracket 22, movement of the handle segment section 38 with respect to the support surface 82.

With regard to the members 40 and 54, the term "static friction" refers to the force resisting movement of the member 54 relative to the member 40 under the action of forces tending to move the member 54, for instance, to the left of FIG. 4.

Thus, the term "static friction" is to be distinguished from kinetic friction that is involved when movement does occur.

In achieving this end in the arrangement of the present invention, the area of contact between the body bracket mounting or support surface 82 and the portion of the uncoupling lever assembly handle segment 27 that engages same is made substantially less than the areas of engagement of the members 40 and 54, as indicated by the showings of FIGS. 4 and canted, At the body bracket 22 the handle section handle 28 in resting on the surface 82 has an area of engagement with the surface 82 that approaches a point contact (due to the convexly rounded exteriors of the surface 82 and rod member 30,) while in the case of the members 40 and 54, the interengagement involved at 100 and 102 is of line configuration or broader at both locations and extends the width of the member 54. Furthermore, under the action of gravity, the ends 48 and 66 of the respective members 40 and 54 become somewhat angled or conted, as indicated in FIG. 4, which tends to further impede tendencies to move the member 54 to the left of the member 40.

The result is that during service, and after lever assembly 20 has been mounted in its operating position illustrated in FIGS. 1 and 2, coupler side swing or buff or draft impacts tending to move the lever assembly 20 sidewise of the car will result in the assembly 20 shifting as a whole, sidewise of the car, at the body bracket support surface 82, and not at the interconnecting portions of the lever assembly tubular members 40 and 54. It is contemplated that as long as the assembly 20 remains in its operative position, no relative movement will in practice occur at the overlapping portions of the tubular members 40 and 54, as a matter of fact they may eventually become affixed against relative movement due to corrosion and foreign matter accumulations.

However, when the lever assembly is to be removed, any bonding together that has resulted at the overlapping portion of members 40 and 54 may be broken by tapping with a hand tool, such as a hammer, and after fastening device 84 has been removed, the handle section 23 can be readily lifted from the body bracket support surface 82 and pulled off of the lock lifter section 24 for removal of the lock lifter section 24 by reversing the manner in which it has been applied to the coupler lock lifter.

Figure 10:
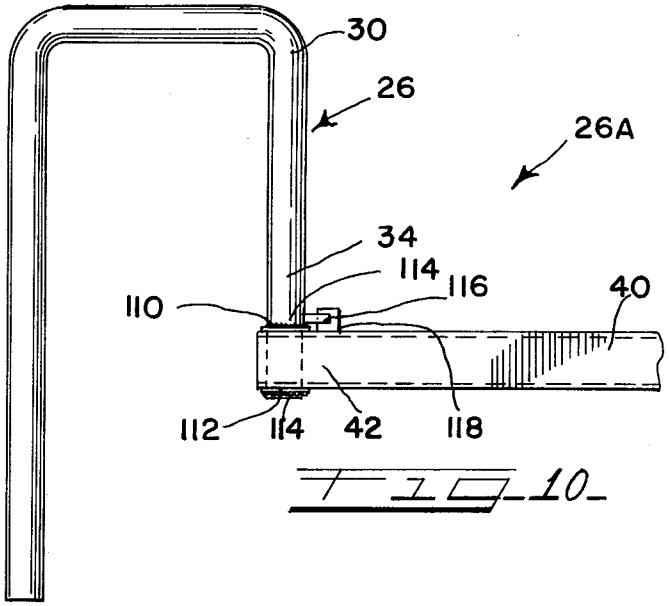
FIG. 10 is a view similar to that of FIG. 7 illustrating a modified form of the invention.
Figure 11:
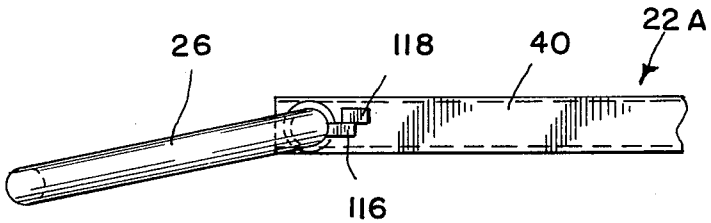
FIG. 11 is a plan view of the structure shown in FIG. 10.

FIGS. 10 and 11 show a modified handle section 23A in which the handle segment 27 has its leg 34 pivotally connected to the handle section tubular member 40, as by applying the handle leg 34 through suitable openings formed through the end 42 of the member 40, with washers 110 and 112 disposed on either side of the member 40 and suitably welded to the handle segment 27, as indicated at 114.

The handle leg 34 also has affixed thereto a lug 116 that cooperates with lug 118 fixed to member 40 to limit the amount of movement permitted by the handle segment 27 relative to its tubular member 40.

The handle section 23A is arranged for application to cars having long coupler stick out where there is an excessive angularity between the body bracket and the coupler lock lifter. The limited pivotal mounting of the handle permits ready application in such instances with the lug 116 engaging lug 118 on operation of the lever assembly (that includes a handle section 28A) to apply through the lever assembly the torque required to operate the lock lifter 26.

SPECIFIC DESCRIPTION

The components making up the arrangement may be made of any suitable materials.

The body bracket 22 per se is an integral casting formed from any material suitable for uncoupling lever purposes.

Rod members 30 and 58 are formed from rod stock made from mild steel or the like, and are suitably shaped to the configurations indicated for each.

Tubular members 40 and 54 are formed from mild steel or the like and are proportioned lengthwise thereof to accommodate application to all freight cars utilizing standard draft gear cushioning and standard striker openings. In one form of the device, the assembly 20 is proportioned to accommodate car widths in the range of from between 8 feet 2 inches to 10 feet 8 inches, with the length proportioning of the tubular members 40 and 54 preferably being such that for the widest car to be accommodated, there will be at least 4 inches of overlap between the members 40 and 54 in the operative position of the assembly 20. Either member 40 and 54 may receive the other insofar as the ends 48 and 68 of same are concerned.

In one specific form of the invention, the lever sections 23 and 24 are proportioned such that when the end 66 of the member 54 is inserted within the member 40 to the extent that the end 66 engages handle leg 34, the distance between the arcuate axis of the hook eye 62 and the handle leg 32 will be 3 feet 7¼ inches, with the lever assembly extending to a maximum length dimension of 5 feet 2 inches with a 4 inch minimum overlap at the engaging portions of the members 40 and 54. Bar 28 is a 1½ inch square tube 2 feet in length and base 52 is a 1¼ inch square tube 2.5 feet in length.

The positioning of the body bracket 22 and the proportioning of the handle legs 34 is preferably made such that in the operative position of the assembly 20 the bars 28 and 52 are approximately horizontally disposed. The handle segment 27 and the rod member 28 are preferably applied to the respective tubular members 40 and 54 so that the upper and lower surfaces of the members 40 and 54 are substantially horizontally disposed, or face vertically, rather than being inclined to the horizontal. The bars 28 and 52 are disposed approximately at the level of the surface 120 of the lock lifter 26 (approximately 10.25 inches below the level of the center line of draft 122 for Type E couplers and 7⅜ inches for Type F couplers) by locating the body bracket 22 so that the area of engagement that the handle section makes with body bracket surface 82 is approximately at the level of the center line of draft (see FIG. 1) and proportioning handle segment leg 34 so that bars 28 and 52 will be substantially horizontally disposed as applied to the car. The center line of draft by AAR regulation is 2 feet 10½ inches above the top of rail.

As indicated by the drawings, the assembly 20 is the optimum in simplicity and it free of any excess weight added by added parts. In a preferred form of the assembly 20 conforming to the embodiment of FIGS. 1–9, the sections 23 and 24 as assembled weight only about 17½ pounds, as compared to the approximately 35 pound weight of the familiar type of solid rod uncoupling lever device.

Figure 3:
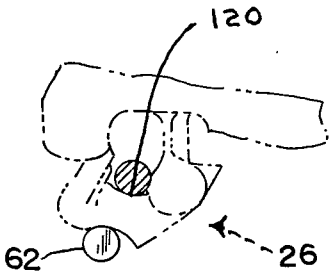
FIG. 3 is a diagrammatic fragmaental view taken substantially along line 3—3 of FIG. 2.
Figure 8:
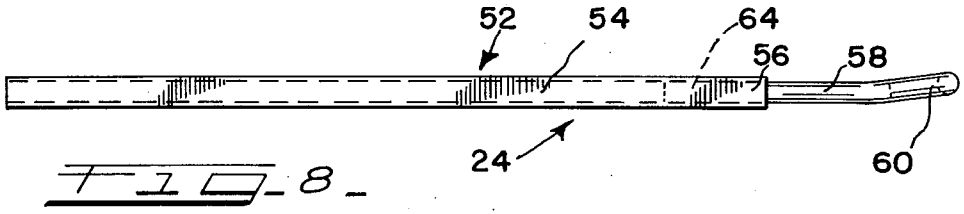
Figure 9:
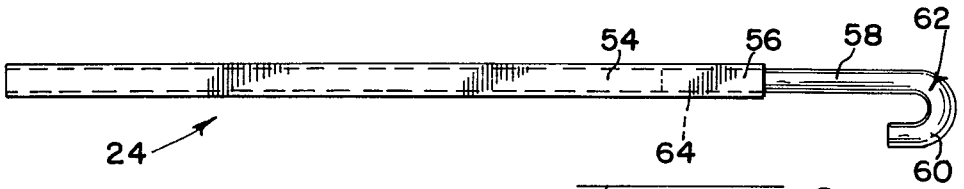
FIG. 9 is a side elevational view of same.

The positioning of the assembly 20 that is illustrated permits ease of operation to open the coupler by the operator grasping the handle leg 32 and swinging it towards the observer in the showing of FIG. 1, or counterclockwise of FIG. 3. The substantial horizontal positioning of the assembly bars 28 and 52, and at the level of the lock lifter are characterized by instance response and lack of undesirable lost motion, and provides an effective working action of the hook eye on the lock lifter 26.

It will be observed, in this connection, that the swinging action of handle segment 27 on mounting surface 82, in the direction to operate the lock lifter 26, involves the lever assembly bars 28 and 52 being acted on through a lever arm represented by handle leg 34, by the operator swinging handle leg 32 in the appropriate direction, that is, toward the observer in the showing of FIG. 1.

In the event of damage to either the handle section 23 or the rod section 24, the damaged section can be replaced without disposing of the undamaged section, by merely disconnecting the handle section in the manner indicated and replacing the damaged assembly section as needed.

The quadrilateral configuration of the assembly bars 28 and 52 structurally reinforces them against bending under the action of most blows occasioned in operation. Any bending of the rod member 58 can be readily straightened out by hammering when needed. Bars 28 and 52 are also free of longitudinally extending interengaging guide slots and lugs for maximum strength and ease of manufacture, and are disposed in operation below where they could be damaged by passed coupler impacts.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a railroad car adapted to ride on track rails and having a coupler mounted at the car centerline of draft and at one end of the car for side to side swinging movement and movement longitudinally of the car in response to buff and draft forces and including a lock lifter for uncoupling the coupler, which car is equipped for standard draft gear cushioning of said buff and draft forces and a standard striker opening, and an uncoupling device therefor including a lever assembly comprising a lock lifter section including a hook eye at one end thereof operatively engaging the lock lifter to actuate same and for support by the coupler, and a handle section including a handle segment at one end thereof pivotally secured to a body bracket mounted on the car to one side of the end of the car, which handle section has a hand grip portion to be grasped by an operator for manually operating the lever assembly to actuate the lock lifter, whereby the lever assembly is supported in its operative position between the bracket and the lock lifter and may be swung about a pivot position to move said hook eye to operate said lock lifter by the operator manually swinging the handle section, the improvement wherein:

said handle section comprises:

an elongate tubular rectilinear bar of quadrilateral transverse cross sectional configuration, said handle segment being of U-shaped configuration defining a pair of spaced apart parallel legs and a connecting portion connecting said legs, said handle segment legs and connecting portion being in coplanar relation, said handle segment connecting portion being rectilinear intermediate said handle segment legs and extending normally thereof, one of said handle segment legs being secured to one end of said handle section bar in perpendicular relation thereto and disposed inboard of the car relative to the other of said handle segment legs, and the other of said handle segment legs projecting below said handle section bar and forming the operator hand grip portion of the handle section, said other of said handle segment legs being spaced outboard of said one end of said handle section bar, said lock lifter section comprising:

an elongate tubular rectilinear bar of quadrilateral transverse cross sectional configuration having the hook eye affixed to one end of same, said handle section bar other end and said lock lifter section bar other end being in substantially coaxial adjustable telescoping torque transmitting relation, which one of said bars being received inside the other bar for supporting said other ends of said bars from the between the lock lifter and body bracket, said bars at said other ends thereof being of substantially complemental transverse cross sectional configuration, with said bars at said other ends thereof being proportioned for free fitting of said one bar within said other bar, said one handle segment leg being proportioned in length to dispose said bars substantially horizontally and approximately at the level of the lock lifter, with said handle segment connecting portion being substantially horizontally disposed, with said other ends of said bars, under the action of gravity when the lever assembly is in its operating position, being canted relative to each other to dispose surface portions at both said other ends thereof in bearing engagement with surface portions of said bars that repectively oppose same, and with said bar surface portions being of substantially line configuration extending transversely of said bars, respectively, said body bracket including a slideway portion extending generally longitudinally of the car on which said handle segment connecting portion rests and extends crosswise thereover to form said pivot position and pivotally secure the handle section to the body bracket, said bracket slideway portion being disposed approximately at the level of the car centerline of draft, said one handle segment leg serving as a lever arm through which said bars are swung about said pivot position by the operator grasping the hand grip portion to move said hook eye to actuate said lock lifter, said bracket slideway portion being convexly contoured longitudinally of said handle segment connecting portion, and said handle segment connecting portion having a convexly rounded exterior surface whereby said bracket slideway portion and said hand segment connecting portion have engaging surface portions, where said handle segment portion rests on said bracket slideway portion, that approximate a point contact, said bar surface portions having a static friction that exceeds that of said handle segment and bracket slideway engaging surface portions to provide means for making said other ends of said bars in stationary relation to said other when the lever assembly is supported in its operative relation against thrusts acting longitudinally of said bars when coupler side swing and buff and draft impacts are occasioned free of fixed connection therebetween, whereby said lever assembly is adjustable lengthwise of said bars by manually moving said bars lengthwise thereof at said other ends of said bars to provide the operating length of the lever assembly on application of the lever assembly to its operative position, and during use, said making means holds the lever assembly to said operating length thereof when coupler side swing and buff and draft impacts are occasioned, and the lever assembly shifts as a unit sidewise of the car at said body bracket and handle segment engaging surface portions when coupler side swing and draft and buff impacts are occasioned.

2. The improvement set forth in claim 1 wherein:

said bars are formed to be freely separated on removal of said handle segment from said body bracket.

3. The improvement set forth in claim 1 wherein:

said handle segment one leg is made fast to said handle section bar.

4. The improvement set forth in claim 1 wherein:

said handle segment one leg is connected to said handle section bar for limited adjustment relative thereto about the axis of said handle segment one leg.

5. The improvement set forth in claim 1 wherein:

said bars are oriented relative to said handle segment and said hook eye such that in the operative position of said assembly, the upper and lower sides of said bars are substantially horizontally disposed.

* * * * *

UNITED STATES PATENT OFFICE

CERTIFICATE OF CORRECTION

Patent No. 4,030,613 Dated June 21, 1977

Inventor(s) Osvaldo F. Chierici

It is certified that error appears in the above-identified patent and that said Letters Patent are hereby corrected as shown below:

Column 3, line 51, "28" should be --23--; Column 3, line 54, "liver" should be --lever--; Column 4, line 66, "2" should be --22--;Column 5, line 2, "22" should be --23--;Column 5, line 32, "828" should be --82--; Column 5, line 52, "canted" should be --5--; Column 5, line 53, "28" should be --23--; Column 5, line 63, "conted" should be --canted--; Column 7, line 35, "it" should be --is--; Column 7, line 38, "weight" should be --weigh--; Column 10, line 5, "said" should be --each--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*